US009353655B2

(12) United States Patent
Demarest et al.

(10) Patent No.: US 9,353,655 B2
(45) Date of Patent: May 31, 2016

(54) OIL PUMP CONTROL SYSTEMS AND METHODS FOR NOISE MINIMIZATION

(71) Applicant: GM GLOBAL TECHNOLOGY OPERATIONS LLC, Detroit, MI (US)

(72) Inventors: Jeremy T. Demarest, Waterford, MI (US); Ronald J. Pierik, Holly, MI (US); Eric D. Staley, Flushing, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 567 days.

(21) Appl. No.: 13/789,804

(22) Filed: Mar. 8, 2013

(65) Prior Publication Data

US 2014/0251273 A1 Sep. 11, 2014

(51) Int. Cl.

| | |
|---|---|
| ***F01M 1/16*** | (2006.01) |
| ***F02D 41/00*** | (2006.01) |
| *F01M 1/02* | (2006.01) |

(52) U.S. Cl.

CPC ..... *F01M 1/16* (2013.01); *F02D 41/0087* (2013.01); *F01M 2001/0276* (2013.01)

(58) Field of Classification Search

CPC ..... F02D 41/0087; F02D 13/06; F02D 17/02; F01M 1/16; F01M 2001/0276; F01M 2011/0008; F01M 2001/1473

USPC ..... 123/198 F, 481, 325, 332, 352, 386, 123/406.23, 406.29, 198 DB, 198 C; 701/110–112; 73/114.15, 114.56; 417/287, 362

See application file for complete search history.

(56) References Cited

U.S. PATENT DOCUMENTS

| | | | | |
|---|---|---|---|---|
| 4,063,466 | A * | 12/1977 | Showalter | F16F 15/12 188/381 |
| 4,777,843 | A * | 10/1988 | Bopp | F16F 15/167 192/205 |
| 4,977,508 | A * | 12/1990 | Tanaka | H02P 29/0016 123/192.1 |
| 5,111,784 | A * | 5/1992 | Kuriyama | F02D 41/083 123/179.3 |
| 5,339,776 | A * | 8/1994 | Regueiro | F01M 1/16 123/196 AB |
| 5,535,643 | A * | 7/1996 | Garza | F16F 15/265 123/192.2 |
| 5,558,178 | A | 9/1996 | Hess et al. | |
| 5,568,795 | A | 10/1996 | Robichaux et al. | |
| 5,623,906 | A | 4/1997 | Storhok | |
| 5,626,108 | A * | 5/1997 | Kato | F01L 1/34406 123/90.15 |
| 5,918,573 | A * | 7/1999 | Killion | F04B 23/04 123/192.2 |
| 5,975,052 | A | 11/1999 | Moyer | |
| 6,253,601 | B1 * | 7/2001 | Wang | F01M 11/10 340/438 |

(Continued)

FOREIGN PATENT DOCUMENTS

| | | |
|---|---|---|
| CN | 101144433 A | 3/2008 |
| CN | 101629524 A | 1/2010 |

(Continued)

OTHER PUBLICATIONS

U.S. Appl. No. 13/712,267, filed Dec. 12, 2012, Staley et al.

*Primary Examiner* — Stephen K Cronin
*Assistant Examiner* — Brian Kirby

(57) ABSTRACT

An engine control system includes a cylinder control module and a pump control module. The cylinder control module selectively deactivates cylinders of an engine. In response to a determination that at least one of the cylinders is deactivated, the pump control module: selectively increases a target displacement for an oil pump that is driven by a balance shaft of the engine; and selectively adjusts displacement of the oil pump based on the target displacement.

12 Claims, 4 Drawing Sheets

(56) References Cited

U.S. PATENT DOCUMENTS 6,286,474 B1 * 9/2001 Downs ..... F16F 15/264 123/192.2
6,615,804 B2 9/2003 Matthews et al.
6,619,258 B2 9/2003 McKay et al.
6,782,865 B2 8/2004 Rayl et al.
6,874,462 B2 4/2005 Matthews
6,895,941 B2 5/2005 Matthews et al.
6,959,684 B2 11/2005 Rayl
7,010,417 B2 3/2006 Edwards, II et al.
7,013,866 B1 3/2006 Prucka et al.
7,018,178 B2 * 3/2006 Hunter ..... F01M 1/16 123/196 R
7,037,088 B2 * 5/2006 Shulver ..... F16F 15/265 123/192.2
7,080,625 B2 * 7/2006 Albertson ..... F02D 41/0087 123/198 F
7,085,647 B1 8/2006 Prucka et al.
7,086,366 B1 * 8/2006 Killion ..... F01M 1/02 123/192.2
7,198,029 B1 4/2007 Wong et al.
7,278,391 B1 * 10/2007 Wong ..... F02D 41/0087 123/192.1
7,322,895 B2 1/2008 Namuduri ..... 474/110
7,523,734 B2 * 4/2009 Albertson ..... B60W 10/06 123/192.1
7,823,566 B2 * 11/2010 Fox ..... F02B 75/06 123/192.1
7,836,866 B2 * 11/2010 Luken ..... F02D 17/02 123/481
8,146,565 B2 4/2012 Leone et al.
8,215,282 B2 * 7/2012 McDonald ..... B60W 10/30 123/198 R
8,347,856 B2 1/2013 Leone et al.
8,499,738 B2 8/2013 Storch et al.
8,734,122 B2 * 5/2014 Murray ..... F01M 1/20 123/196 CP
2001/0037793 A1 11/2001 Robichaux et al.
2002/0170527 A1 11/2002 Rayl et al.
2003/0136371 A1 * 7/2003 Killion ..... F01M 1/02 123/198 C
2003/0172892 A1 * 9/2003 Glugla ..... F02B 75/22 123/179.5
2003/0213469 A1 11/2003 Rayl
2004/0055569 A1 3/2004 Matthews et al.
2004/0088981 A1 * 5/2004 Ollis ..... F01C 1/22 60/645
2005/0003925 A1 1/2005 Wakashiro et al.
2005/0016492 A1 1/2005 Matthews
2005/0076882 A1 4/2005 Rayl
2005/0257778 A1 11/2005 Albertson et al.
2006/0104823 A1 * 5/2006 Hunter ..... F01M 1/16 417/44.2
2006/0254555 A1 * 11/2006 Berger ..... B60W 10/06 123/192.1
2007/0032322 A1 * 2/2007 Beardmore ..... F16H 7/0848 474/110
2007/0042861 A1 2/2007 Takaoka et al.
2007/0068486 A1 3/2007 Rozario et al.
2008/0066718 A1 3/2008 Sato et al.
2008/0154468 A1 * 6/2008 Berger ..... B60K 6/365 701/54
2008/0236540 A1 10/2008 Hartmann et al.
2008/0273992 A1 * 11/2008 Killion ..... F04B 23/12 417/185
2009/0012665 A1 1/2009 Brennan et al.
2010/0012072 A1 * 1/2010 Leone ..... F02D 41/0087 123/192.1
2010/0139611 A1 * 6/2010 Hunter ..... F04C 2/3442 123/196 R
2010/0154526 A1 * 6/2010 Cinpinski ..... F01L 1/3442 73/114.79
2010/0280738 A1 11/2010 Whitney et al.
2011/0139117 A1 6/2011 Kar et al.
2011/0209682 A1 * 9/2011 Storch ..... F01M 1/02 123/196 R
2011/0251756 A1 10/2011 Major et al.
2012/0029787 A1 2/2012 Whitney et al.
2012/0065857 A1 3/2012 Nanua
2012/0191316 A1 7/2012 Leone et al.
2013/0060453 A1 * 3/2013 McDonald ..... F02D 13/06 701/112

FOREIGN PATENT DOCUMENTS

CN 102191967 A 9/2011
JP 01135964 A * 5/1989
JP 03261306 A * 11/1991

* cited by examiner

OIL PUMP CONTROL SYSTEMS AND METHODS FOR NOISE MINIMIZATION

FIELD

The present disclosure relates to internal combustion engines and more particularly to control systems and methods for oil pumps.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, injection of the fuel or spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other inputs. The driver inputs may include, for example, accelerator pedal position, brake pedal position, and/or one or more other suitable driver inputs. The other inputs may include, for example, one or more measured values and/or one or more parameters determined based on one or more measured values.

SUMMARY

An engine control system includes a cylinder control module and a pump control module. The cylinder control module selectively deactivates cylinders of an engine. In response to a determination that at least one of the cylinders is deactivated, the pump control module: selectively increases a target displacement for an oil pump that is driven by a balance shaft of the engine; and selectively adjusts displacement of the oil pump based on the target displacement.

In further features, the engine is a four-cylinder engine, and the pump control module determines the target displacement when two of the cylinders are deactivated and two of the cylinders are activated.

In still further features, the pump control module determines the target displacement in response to determinations that an engine speed is less than a predetermined speed and that at least one of the cylinders is deactivated.

In yet further features, the pump control module determines the target displacement in response to determinations that a temperature of the engine is greater than a predetermined temperature and that at least one of the cylinders is deactivated.

In further features, the pump control module determines the target displacement in response to determinations that an engine speed is less than a predetermined speed, that a temperature of the engine is greater than a predetermined temperature, and that at least one of the cylinders is deactivated.

In still further features, the pump control module determines the target displacement based on an engine speed.

In yet further features, the pump control module: increases the target displacement as the engine speed decreases; and decreases the target displacement as the engine speed increases.

In further features, the pump determines the target displacement based on a temperature of the engine.

In still further features, the pump control module: decreases the target displacement as the temperature decreases; and increases the target displacement as the temperature increases.

In yet further features the engine control system further includes a fuel control module that disables fueling to first selected ones of the cylinders that are deactivated and that provides fuel to second selected ones of the cylinders that are activated.

An engine control method includes selectively deactivating cylinders of an engine and, in response to a determination that at least one of the cylinders is deactivated: selectively increasing a target displacement for an oil pump that is driven by a balance shaft of the engine; and selectively adjusting displacement of the oil pump based on the target displacement.

In further features, the engine control method further includes determining the target displacement when two of the cylinders of a four-cylinder engine are deactivated and two of the cylinders are activated.

In still further features, the engine control method further includes determining the target displacement in response to determinations that an engine speed is less than a predetermined speed and that at least one of the cylinders is deactivated.

In yet further features, the engine control method further includes determining the target displacement in response to determinations that a temperature of the engine is greater than a predetermined temperature and that at least one of the cylinders is deactivated.

In further features, the engine control method further includes determining the target displacement in response to determinations that an engine speed is less than a predetermined speed, that a temperature of the engine is greater than a predetermined temperature, and that at least one of the cylinders is deactivated.

In still further features, the engine control method further includes determining the target displacement based on an engine speed.

In yet further features, the engine control method further includes: increasing the target displacement as the engine speed decreases; and decreasing the target displacement as the engine speed increases.

In further features, the engine control method further includes determining the target displacement based on a temperature of the engine.

In still further features, the engine control method further includes: decreasing the target displacement as the temperature decreases; and increasing the target displacement as the temperature increases.

In yet further features, the engine control method further includes: disabling fueling to first selected ones of the cylinders that are deactivated; and providing fuel to second selected ones of the cylinders that are activated.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

An engine combusts air and fuel within cylinders to generate torque. An engine control module (ECM) controls the torque output of the engine. The ECM may control the torque output of the engine based on driver inputs, such as accelerator pedal position, brake pedal position, and/or one or more other suitable driver inputs.

The engine outputs torque to a transmission via a crankshaft. The crankshaft drives an oil pump via an oil pump drivetrain. For example, the crankshaft drives one or more balance shafts. The balance shaft(s) attenuate vibration produced by combustion and/or mechanical forces within the engine. In some instances, a balance shaft drives the oil pump. The oil pump pumps engine oil from a sump to various locations within the engine.

Under some circumstances, the ECM may deactivate one or more cylinders of the engine. When one or more cylinders are deactivated, however, the period between combustion events may be such that a combustion event may cause the oil pump drivetrain to produce audible noise, such as a tick or a rattle between drive and driven gears.

The ECM of the present disclosure selectively adjusts the displacement of the oil pump to minimize or prevent the occurrence of such audible noise. More specifically, the ECM increases the displacement of the oil pump to increase the torque load of the oil pump. The increased torque load of the oil pump maintains the components of the oil pump drivetrain in contact with each other and minimizes the audible noise produced by the oil pump drivetrain.

Figure 1:
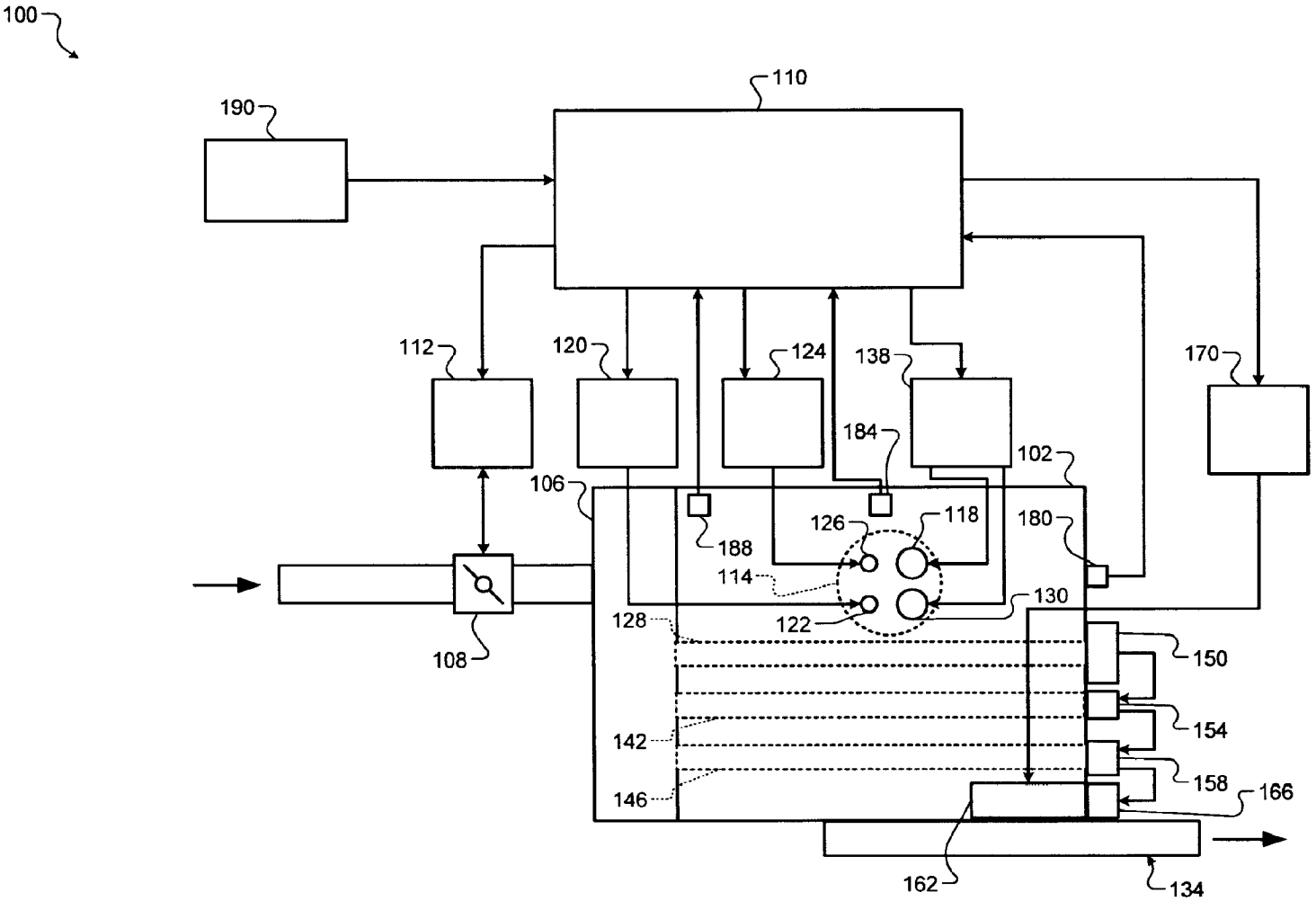
FIG. 1 is a functional block diagram of an example engine system according to the present disclosure.

Referring now to FIG. 1, a functional block diagram of an example engine system 100 is presented. The engine system 100 includes an engine 102 that combusts an air/fuel mixture to produce drive torque for a vehicle. While not shown, one or more electric motors and/or motor generator units (MGUs) may be provided with the engine 102.

Air is drawn into an intake manifold 106 through a throttle valve 108. The throttle valve 108 varies airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. The engine 102 may be a single-cylinder engine, a two-cylinder engine, a four-cylinder engine, a six-cylinder engine, an eight-cylinder engine, or an engine having another suitable number of cylinders. Air from the intake manifold 106 is drawn into the cylinder 114 through one or more intake valves, such as intake valve 118.

A fuel actuator module 120 controls a fuel injector 122 of the cylinder 114 based on signals from the ECM 110 to control fuel injection (e.g., amount and timing) into the cylinder 114. While direct fuel injection is shown and discussed, port fuel injection or another suitable type of fuel injection may be used. The ECM 110 may control fuel injection to achieve a desired air/fuel ratio, such as a stoichiometric air/fuel ratio.

The injected fuel mixes with air and creates an air/fuel mixture in the cylinder 114. Based upon a signal from the ECM 110, a spark actuator module 124 may energize a spark plug 126 of the cylinder 114. Spark generated by the spark plug 126 may ignite the air/fuel mixture. In various implementations, heat generated by compression may ignite the air/fuel mixture.

The engine 102 may operate using a four-stroke cycle or another suitable operating cycle. The four strokes, described below, may be referred to as the intake stroke, the compression stroke, the combustion stroke, and the exhaust stroke. During each revolution of a crankshaft 128, two of the four strokes occur within the cylinder 114. Therefore, two revolutions of the crankshaft 128 are necessary for all of the cylinders to experience all four of the strokes.

During the intake stroke, air from the intake manifold 106 is drawn into the cylinder 114 through the intake valve 118. Fuel injected by the fuel injector 122 mixes with air and creates an air/fuel mixture in the cylinder 114. One or more fuel injections may be performed during a combustion cycle. During the compression stroke, a piston (not shown) within the cylinder 114 compresses the air/fuel mixture. During the combustion stroke, combustion of the air/fuel mixture drives the piston, thereby driving the crankshaft 128. During the exhaust stroke, the byproducts of combustion are expelled through one or more exhaust valves, such as exhaust valve 130, to an exhaust system 134.

A valve actuator module 138 controls the intake and exhaust valves 118 and 130. For example, the valve actuator module 138 may control opening and closing timing of the intake and/or exhaust valves 118 and 130 and/or lift of the intake and/or exhaust valves 118 and 130. The valve actuator module 138 may also control whether the intake and exhaust valves 118 and 130 are activated or deactivated. One or more cylinders of the engine 102 may be deactivated under some circumstances, for example, to decrease fuel consumption.

The engine 102 also includes one or more balance shafts, such as a first balance shaft 142 and a second balance shaft 146. Rotation of the first balance shaft 142 is driven by the crankshaft 128. A first toothed wheel 150 may be coupled to and rotate with the crankshaft 128, and a second toothed wheel 154 may be coupled to and rotate with the first balance shaft 142. The first toothed wheel 150 may directly drive the second toothed wheel 154 or drive the second toothed wheel 154 via a belt, a chain, a gear drive mechanism, or in another suitable manner.

Rotation of the second balance shaft 146 may be driven by the first balance shaft 142. A third toothed wheel 158 may be coupled to and rotate with the second balance shaft 146. The second toothed wheel 154 may directly drive the third toothed wheel 158 or drive the third toothed wheel 158 via a belt, a chain, a gear drive mechanism, or in another suitable manner.

An oil pump 162 is driven by a balance shaft, such as the second balance shaft 146. For example only, a fourth toothed wheel 166 may be coupled to and rotate with an input shaft of the oil pump 162. The third toothed wheel 158 may directly drive the fourth toothed wheel 166 or drive the fourth toothed wheel 166 via a belt, a chain, a gear drive mechanism, or in another suitable manner. While the oil pump 162 is shown and described as being driven by the second balance shaft 146, the oil pump 162 may be driven by the first balance shaft 142. The toothed wheels, belt(s), chain(s), and/or gear drive mechanism(s) that drive the oil pump 162 may be referred to as an oil pump drivetrain.

The oil pump 162 draws (engine) oil from a sump (not shown) and pumps the oil to various locations within the engine 102. The oil pump 162 is a variable displacement pump. A pump actuator module 170 controls displacement of the oil pump 162 based on signals from the ECM 110. The displacement of the oil pump 162 dictates how much oil the oil pump 162 pumps. For example, the oil pump 162 pumps more oil as the displacement increases and vice versa.

The engine system 100 includes a plurality of sensors, such as a crankshaft position sensor 180, an oil temperature (OT) sensor 184, and an engine coolant temperature (ECT) sensor 188. The crankshaft position sensor 180 monitors rotation of the crankshaft 128 and generates a crankshaft position signal based on the rotation of the crankshaft 128. For example only, the crankshaft position sensor 180 may include a variable reluctance (VR) sensor or another suitable type of crankshaft position sensor.

The OT sensor 184 measures temperature of the oil and generates an OT signal based on the temperature of the oil. The ECT sensor 188 measures temperature of engine coolant and generates an ECT signal based on the temperature of the engine coolant. While the ECT sensor 188 is shown as being implemented within the engine 102, the ECT sensor 188 may be implemented at another location where the engine coolant is circulated, such as in a radiator or in a coolant line.

The engine system 100 may also include one or more other sensors 190. For example, the other sensors 190 may include one or more fuel pressure sensors, a mass air flowrate (MAF) sensor, a manifold absolute pressure (MAP) sensor, an intake air temperature (IAT) sensor, and/or one or more other suitable sensors.

Under some circumstances, the period between cylinder firing events of the engine 102 may be such that the drivetrain of the oil pump 162 may generate audible noise after combustion within a cylinder. The audible noise (e.g., tick or rattle) may be attributable to teeth of a toothed wheel losing contact with a component that drives the toothed wheel before combustion and contacting the component as a result of the combustion. The ECM 110 of the present disclosure selectively adjusts the displacement of the oil pump 162 to vary the torque of the oil pump 162 in an effort to maintain toothed wheel contact to minimize or prevent the occurrence of such audible noise.

Figure 2:
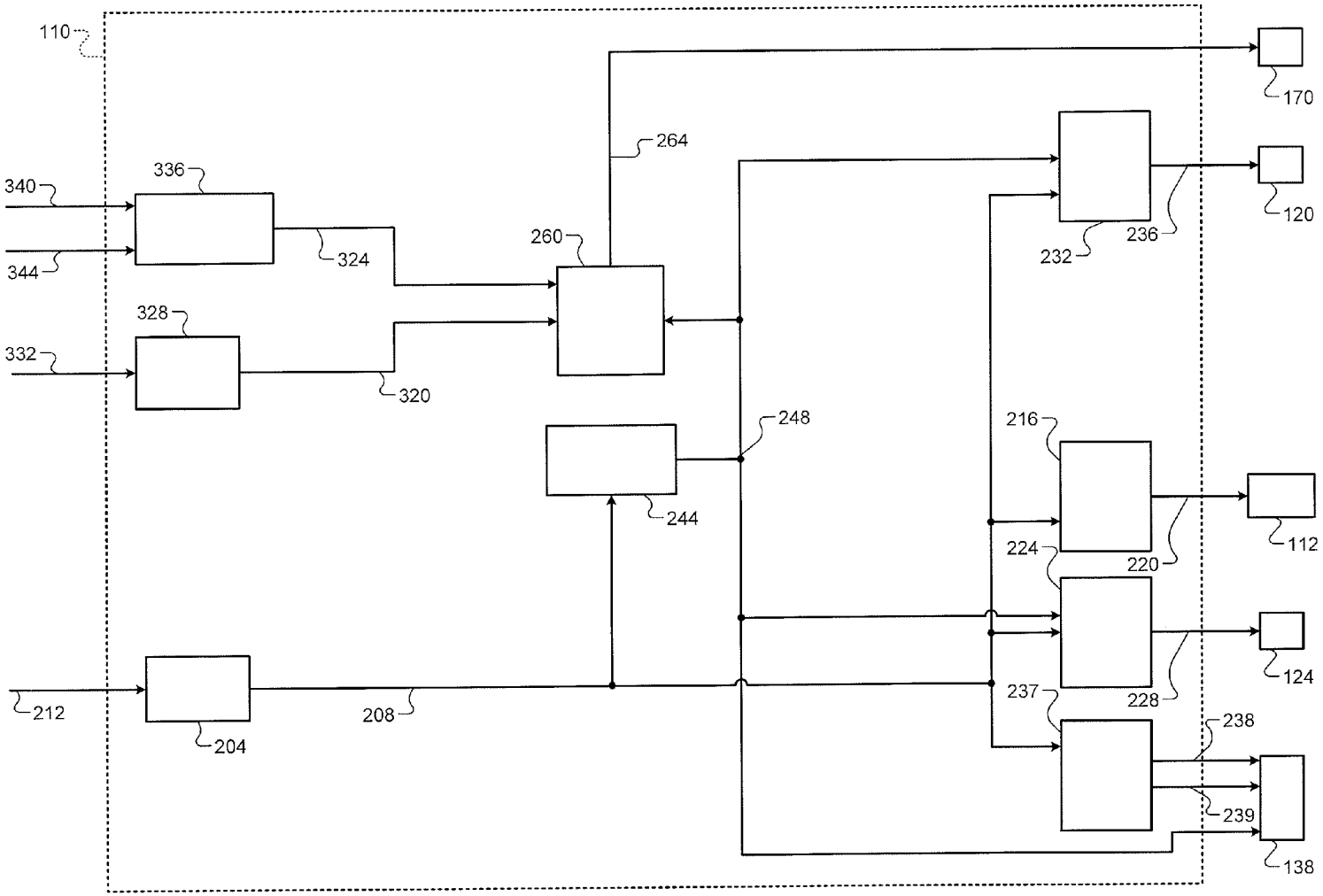
FIG. 2 is a functional block diagram of an example engine control system according to the present disclosure.

Referring now to FIG. 2, a functional block diagram of an example engine control system including the ECM 110 is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 110 and/or torque requests received from other modules of the vehicle, such as a transmission control module, a hybrid control module, a chassis control module, etc.

One or more engine actuators may be controlled based on the torque request 208 and/or one or more other parameters. For example, a throttle control module 216 may determine a target throttle opening 220 based on the torque request 208. The throttle actuator module 112 may adjust opening of the throttle valve 108 based on the target throttle opening 220.

A spark control module 224 may determine a target spark timing 228 based on the torque request 208. The spark actuator module 124 may generate spark based on the target spark timing 228. A fuel control module 232 may determine one or more target fueling parameters 236 based on the torque request 208. For example, the target fueling parameters 236 may include fuel injection amount, number of fuel injections for injecting the amount, and timing for each of the injections. The fuel actuator module 120 may inject fuel based on the target fueling parameters 236.

A valve control module 237 may determine target intake and exhaust valve parameters 238 and 239 based on the torque request 208. The valve actuator module 138 may regulate intake and exhaust valve actuation based on the desired intake and exhaust valve parameters 238 and 239, respectively. For example only, the target intake and exhaust valve parameters 238 and 239 may include intake and exhaust valve opening and closing timing, lift, and/or one or more other parameters.

A cylinder control module 244 determines a target cylinder activation/deactivation sequence 248 based on the torque request 208. The valve actuator module 138 deactivates the intake and exhaust valves of the cylinders that are to be deactivated according to the target cylinder activation/deactivation sequence 248. The valve actuator module 138 allows opening and closing of the intake and exhaust valves of cylinders that are to be activated according to the target cylinder activation/deactivation sequence 248.

Fueling is halted (zero fueling) to cylinders that are to be deactivated according to the target cylinder activation/deactivation sequence 248, and fuel is provided to the cylinders that are to be activated according to the target cylinder activation/deactivation sequence 248. Spark is provided to the cylinders that are to be activated according to the target cylinder activation/deactivation sequence 248. Spark may be provided or halted to cylinders that are to be deactivated according to the target cylinder activation/deactivation sequence 248. Cylinder deactivation is different than fuel cutoff (e.g., deceleration fuel cutoff) in that the intake and exhaust valves of cylinders to which fueling is halted during fuel cutoff are still opened and closed during the fuel cutoff whereas the intake and exhaust valves are maintained closed when deactivated.

Figure 3:
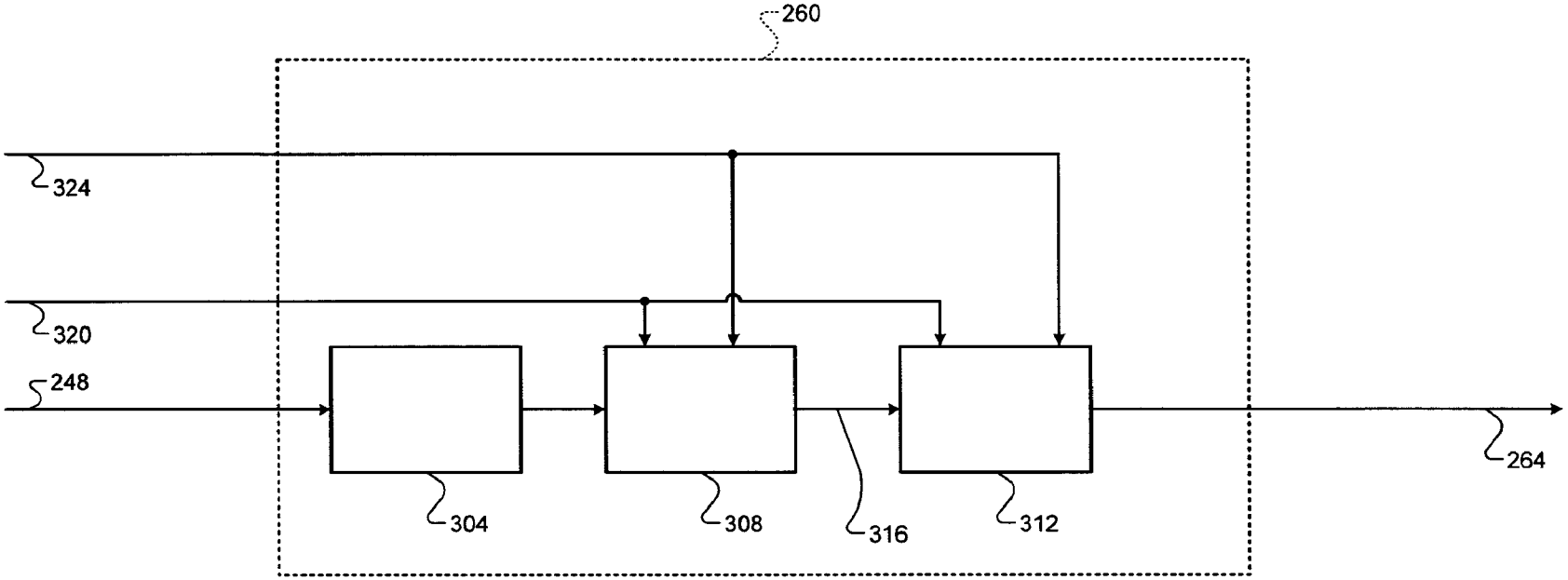
FIG. 3 is a functional block diagram of a pump control module according to the present disclosure.

A pump control module 260 determines a target displacement 264 for the oil pump 162, and the pump actuator module 170 adjusts the displacement of the oil pump 162 based on the target displacement 264. The pump control module 260 selectively sets the target displacement 264 to minimize or prevent generation of audible noise by the oil pump drivetrain. FIG. 3 is a functional block diagram of an example implementation of the pump control module 260.

Referring now to FIGS. 2 and 3, the pump control module 260 may include an enabling module 304, a triggering module 308, and a target displacement module 312. The enabling module 304 selectively enables and disables the triggering module 308 based on whether one or more enabling conditions are satisfied. The oil pump drivetrain may generate audible noise when the enabling condition(s) are satisfied.

For example only, the enabling module 304 may enable the triggering module 308 when half of the cylinders of an even firing engine (e.g., two cylinders of a four-cylinder engine) are deactivated per engine cycle. If the engine 102 is a two-cylinder engine or operating as a two-cylinder engine, the enabling module 304 may enable the triggering module 308. The enabling module 304 may disable the triggering module 308 when one or more of the enabling conditions are not satisfied.

When enabled, the triggering module 308 generates a trigger signal 316 based on one or more engine operating conditions. For example only, the triggering module 308 may set the trigger signal 316 to a first state when an engine speed 320 is less than a predetermined speed and an engine temperature 324 is greater than a predetermined temperature. The triggering module 308 may set the trigger signal 316 to a second state when the engine speed 320 is greater than the predetermined speed and/or the engine temperature 324 is less than the predetermined temperature. The predetermined speed may be calibratable and may be set, for example, based on an idling speed of the engine 102. For example only, the predetermined speed may be approximately 1000 revolutions per minute (RPM)—approximately 1500 RPM or another suitable speed. The predetermined temperature may be calibratable and may be set, for example, based on a steady-state temperature of the engine 102 at idle. For example only, the predetermined temperature may be approximately 121 degrees Celsius or less. The triggering module 308 may set the trigger signal 316 to the second state when disabled.

Viscosity of engine oil is an inverse function of the engine temperature 324. Thus, oil viscosity increases as the engine temperature 324 decreases, and vice versa. Due to the lower oil viscosity (and therefore lower oil pump torque) at higher engine temperatures, audible noise may be more likely when the engine temperature 324 is greater than the predetermined temperature.

An engine speed module 328 (see FIG. 2) may determine the engine speed 320, for example, based on a crankshaft position 332 measured using the crankshaft position sensor 180. An engine temperature module 336 (see FIG. 2) may determine the engine temperature 324, for example, based on an ECT 340 measured using the ECT sensor 188 and/or an OT 344 measured using the OT sensor 184. The engine temperature 324 is related to the viscosity of the oil pumped by the oil pump 162. While use of whether the engine temperature 324 is less than the predetermined temperature is discussed above, use of a viscosity related condition (e.g., viscosity less than a predetermined value) may be used additionally or alternatively.

The target displacement module 312 (FIG. 3) determines the target displacement 264 for the oil pump 162. When the trigger signal 316 is in the second state, the target displacement module 312 may determine the target displacement 264 for operation in a normal mode. Determining the target displacement 264 for operation in the normal mode may include, for example, determining the target displacement 264 based on one or more suitable inputs.

When the trigger signal 316 is in the first state, the target displacement module 312 determines the target displacement 264 based on the engine speed 320 and the engine temperature 324. The target displacement module 312 may determine the target displacement 264, for example, using one of a function and a mapping that relates the engine speed 320 and the engine temperature 324 to the target displacement 264. For example only, the target displacement module 312 may increase the target displacement 264 as the engine speed 320 decreases and vice versa. Additionally or alternatively, the target displacement module 312 may increase the target displacement 264 as the engine temperature 324 increases and vice versa.

Relative to values of the target displacement 264 determined for operation in the normal mode, values of the target displacement 264 determined based on the engine speed 320 and the engine temperature 324 are larger. Thus, the target displacement module 312 increases the target displacement 264 when the trigger signal 316 is in the first state. The target displacement module 312 may apply one or more filters before outputting the target displacement 264, for example, to rate limit changes in the target displacement 264 associated with changes in the state of the trigger signal 316.

Figure 4:
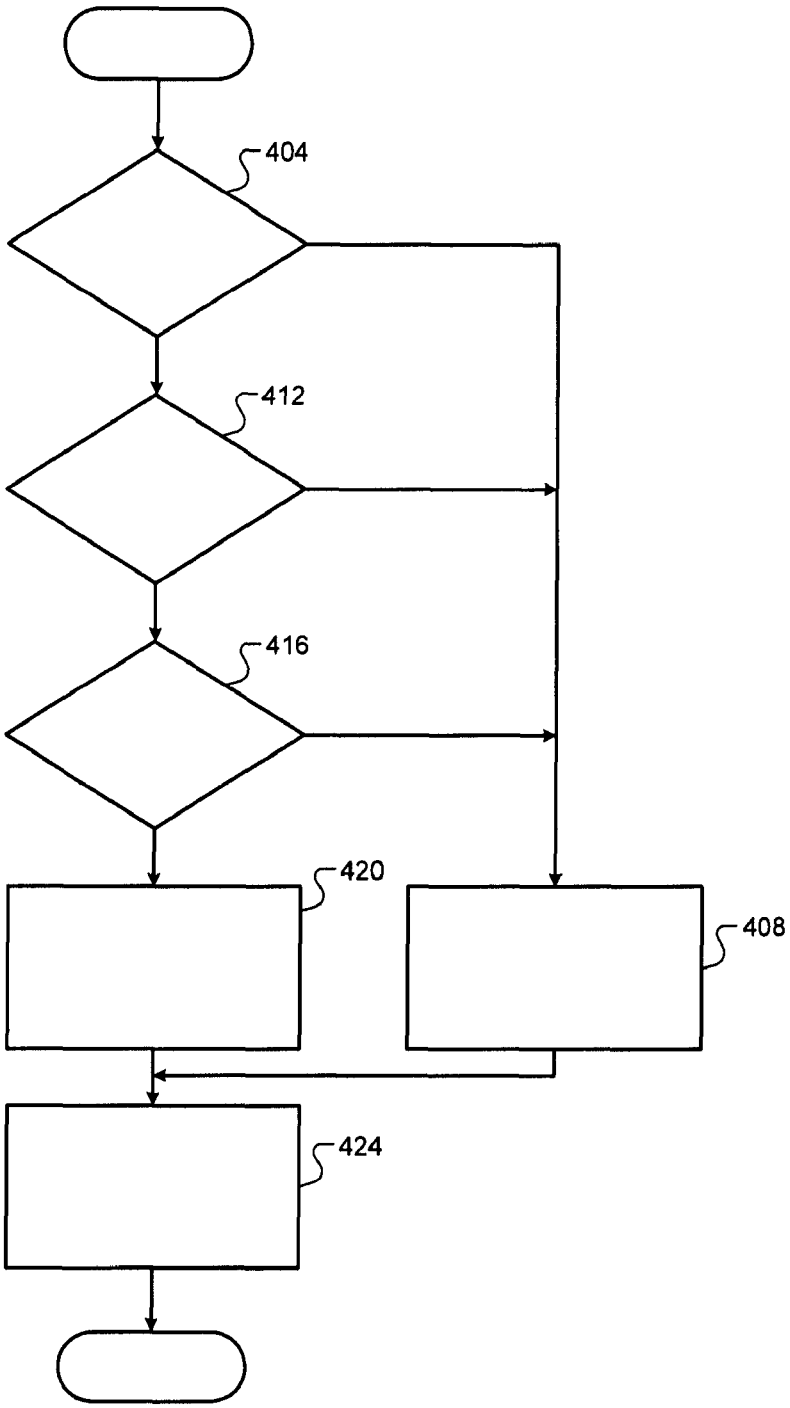
FIG. 4 is a flowchart depicting an example method of controlling a balance shaft driven oil pump according to the present disclosure.

Referring now to FIG. 4, a flowchart depicting an example method of controlling the oil pump 162 is presented. At 404, the enabling module 304 determines whether the one or more enabling conditions are satisfied. If 404 is false, control transfers to 408. At 408, the target displacement module 312 determines the target displacement 264 for operation in the normal mode, and control continues with 424 which is discussed further below. If 404 is true, the enabling module 304 enables the triggering module 308, and control continues with 412.

At 412, the triggering module 308 determines whether the engine speed 320 is less than the predetermined speed. If 412 is true, control continues with 416. If 412 is false, control transfers to 408, which is discussed above. At 416, the triggering module 308 determines whether the engine temperature 324 is greater than the predetermined temperature. If 416 is true, the triggering module 308 sets the trigger signal 316 to the first state, and control continues with 420. If 416 is false, control transfers to 408, which is discussed above. For example only, the predetermined speed may be approximately 1000 revolutions per minute (RPM)—approximately 1500 RPM or another suitable speed, and the predetermined temperature may be approximately 121 degrees Celsius or less.

The target displacement module 312 determines the target displacement 264 for the oil pump 162 at 420. The target displacement module 312 determines the target displacement 264 at 420 based on the engine speed 320 and the engine temperature 324. For example, the target displacement module 312 may increase the target displacement 264 as the engine speed 320 decreases and vice versa and/or increase the target displacement 264 as the engine temperature 324 increases and vice versa. At 424, the displacement of the oil pump 162 is controlled based on the target displacement 264. The increase in the displacement of the oil pump 162 (relative to operation in the normal mode) increases the torque load of the oil pump 162. The increased torque load of the oil pump 162 maintains the components of the oil pump drivetrain in contact with each other, thereby minimizing audible noise produced by the oil pump drivetrain. While control is shown as ending, FIG. 4 is illustrative of one control loop, and a control loop may be executed, for example, every predetermined amount of crankshaft rotation.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. An engine control system of a vehicle, comprising:
- a cylinder control module that selectively deactivates cylinders of an engine; and
- a pump control module that:
  - determines a target displacement for an oil pump that is driven by a balance shaft of the engine;
  - in response to determinations that at least one of the cylinders is deactivated and an engine speed is less than a predetermined speed:
    - selectively increases the target displacement based on the engine speed and an engine coolant temperature using at least one function or mapping that relates engine speeds and engine coolant temperatures to target displacements; and
    - selectively adjusts displacement of the oil pump based on the target displacement.

2. The engine control system of claim 1 wherein the engine is a four-cylinder engine and the pump control module determines the target displacement when two of the cylinders are deactivated and two of the cylinders are activated and the engine speed is less than the predetermined speed.

3. The engine control system of claim 1 wherein the pump control module determines the target displacement in response to determinations that the engine speed is less than the predetermined speed, that a temperature of the engine is greater than a predetermined temperature, and that at least one of the cylinders is deactivated.

4. The engine control system of claim 1 wherein the pump control module:
- increases the target displacement as the engine speed decreases; and
- decreases the target displacement as the engine speed increases.

5. The engine control system of claim 1 wherein the pump control module:
- decreases the target displacement as the engine coolant temperature decreases; and
- increases the target displacement as the engine coolant temperature increases.

6. The engine control system of claim 1 further comprising a fuel control module that disables fueling to first selected ones of the cylinders that are deactivated and that provides fuel to second selected ones of the cylinders that are activated.

7. An engine control method for a vehicle, comprising:
- selectively deactivating cylinders of an engine;
- determining a target displacement for an oil pump that is driven by a balance shaft of the engine; and,
- in response to a determinations that at least one of the cylinders is deactivated and an engine speed is less than a predetermined speed:
  - selectively increasing the target displacement based on the engine speed and an engine coolant temperature using at least one function or mapping that relates engine speeds and engine coolant temperatures to target displacements; and
  - selectively adjusting displacement of the oil pump based on the target displacement.

8. The engine control method of claim 7 wherein determining the target displacement comprises determining the target displacement when two of the cylinders of a four-cylinder engine are deactivated and two of the cylinders are activated and the engine speed is less than the predetermined speed.

9. The engine control method of claim 7 further comprising determining the target displacement in response to determinations that the engine speed is less than the predetermined speed, that a temperature of the engine is greater than a predetermined temperature, and that at least one of the cylinders is deactivated.

10. The engine control method of claim 7 further comprising:
- increasing the target displacement as the engine speed decreases; and
- decreasing the target displacement as the engine speed increases.

11. The engine control method of claim 7 further comprising:
- decreasing the target displacement as the engine coolant temperature decreases; and
- increasing the target displacement as the engine coolant temperature increases.

12. The engine control method of claim 7 further comprising:
- disabling fueling to first selected ones of the cylinders that are deactivated; and
- providing fuel to second selected ones of the cylinders that are activated.

* * * * *